US012005310B2

(12) United States Patent
Malagon

(10) Patent No.: US 12,005,310 B2
(45) Date of Patent: Jun. 11, 2024

(54) APPARATUS AND METHOD FOR EXERCISING CALF AND THIGH MUSCLES

(71) Applicant: Sylverio Malagon, Rancho Cucamonga, CA (US)

(72) Inventor: Sylverio Malagon, Rancho Cucamonga, CA (US)

( * ) Notice: Subject to any disclaimer, the term of this patent is extended or adjusted under 35 U.S.C. 154(b) by 0 days.

(21) Appl. No.: 17/302,663

(22) Filed: May 10, 2021

(65) Prior Publication Data

US 2022/0273982 A1 Sep. 1, 2022

Related U.S. Application Data

(60) Provisional application No. 63/200,278, filed on Feb. 26, 2021.

(51) Int. Cl.
*A63B 23/035* (2006.01)
*A63B 21/068* (2006.01)
*A63B 23/08* (2006.01)

(52) U.S. Cl.
CPC ..... *A63B 23/03525* (2013.01); *A63B 21/068* (2013.01); *A63B 23/08* (2013.01); *A63B 2208/0204* (2013.01)

(58) Field of Classification Search
CPC ..... A63B 21/00047; A63B 21/4029; A63B 21/0023; A63B 21/02; A63B 21/04; A63B 21/055; A63B 21/0552; A63B 21/068; A63B 21/0411; A63B 21/4013; A63B 21/4015; A63B 21/4037; A63B 21/4039; A63B 23/035; A63B 23/03516; A63B 23/03525; A63B 23/0355; A63B 23/04; A63B 23/0458; A63B 23/0464; A63B 2023/0411
See application file for complete search history.

(56) References Cited

U.S. PATENT DOCUMENTS 7,036,169 B2 * 5/2006 Marshall ..... A61B 6/0421 5/651
10,960,260 B1 * 3/2021 Weber ..... A63B 23/04
2003/0207738 A1 * 11/2003 Wong ..... A63B 21/00047 482/53
2004/0093673 A1 * 5/2004 Marshall ..... A61G 13/12 5/601
2005/0107226 A1 * 5/2005 Monda ..... A63B 21/04 482/121
2006/0189448 A1 * 8/2006 Flentye ..... A63B 23/0458 482/52
2010/0167886 A1 * 7/2010 Ko ..... A63B 22/16 482/142
2011/0124473 A1 * 5/2011 Kole ..... A63B 23/10 482/79
2011/0251531 A1 * 10/2011 Johnson ..... A63B 23/0494 601/5

(Continued)

*Primary Examiner* — Zachary T Moore
(74) *Attorney, Agent, or Firm* — Dunlap Bennett & Ludwig, PLLC

(57) ABSTRACT

An exercise step and method of exercising a user's legs is disclosed. The exercise step includes a main body which has a substantially planar and horizontally oriented upper wall and a sloped wall extending from bottommost surface of the exercise step to the upper wall. In use, a user steps on the sloped wall with a heel portion of his or her foot and raises the heel portion such that a sole portion of his or her foot is supported by the upper wall.

4 Claims, 4 Drawing Sheets

(56) References Cited

U.S. PATENT DOCUMENTS

| | | | | |
|---|---|---|---|---|
| 2014/0031183 | A1* | 1/2014 | Blake | A63B 21/04 482/130 |
| 2014/0256525 | A1* | 9/2014 | Mueller | A61H 1/0292 482/142 |
| 2015/0264997 | A1* | 9/2015 | Myles | A63B 21/4015 36/81 |
| 2017/0080284 | A1* | 3/2017 | Hillson | A63B 21/4033 |
| 2017/0239507 | A1* | 8/2017 | Haas | A63B 21/00061 |

* cited by examiner

APPARATUS AND METHOD FOR EXERCISING CALF AND THIGH MUSCLES

CROSS-REFERENCE TO RELATED APPLICATION

This application claims the benefit of priority of U.S. provisional application No. 63/200,278, filed Feb. 26, 2021, the contents of which are herein incorporated by reference.

BACKGROUND OF THE INVENTION

The present invention relates to exercise equipment and, more particularly, to an exercise step that helps exercise the calf muscles and thigh muscles in a user's legs.

Many forms of exercise equipment exist in the fitness industry. However, most of these devices are complex and mechanical in nature (i.e., has moving parts), which often results in them requiring significant space for use and/or are cost-prohibitive for an average user to acquire. Consequently, the overwhelming majority of available exercise equipment is mechanical and exists only in gyms.

Because this type of equipment is largely left for gym use, users have no viable exercise options for at home, work, or other locations they frequent (besides the gym). No non-mechanical exercise leg equipment exists to specifically target the calf and thigh muscles.

As can be seen, there is a need for an apparatus and method for non-mechanically exercising calf and thigh muscles, as described herein.

SUMMARY OF THE INVENTION

In one aspect of the present invention, an exercise step configured for use with leg exercises is disclosed, and comprises: a main body comprising: a substantially planar and horizontally oriented upper wall configured to support a sole portion of a user foot; and a sloped wall extending from a bottommost surface of the exercise step to the upper wall, the sloped wall being configured to support a heel portion of the user foot.

In another aspect of the present invention, a method of exercising a user's legs is disclosed, with the method comprising the steps of: providing an exercise step comprising a main body, the main body comprising: a substantially planar and horizontally oriented upper wall; and a sloped wall extending from a bottommost surface of the exercise step to the upper wall; stepping on the sloped wall with a heel portion of a user foot; and raising the heel portion such that a sole portion of the user foot is supported by the upper wall.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides an exercise step including a main body that comprises: (1) a substantially planar and horizontally oriented upper wall that is configured to support a sole portion of a user foot; and (2) a sloped wall that extends from a bottommost surface of the exercise step to the upper wall, with the sloped wall being configured to support a heel portion of the user foot.

Figure 1:
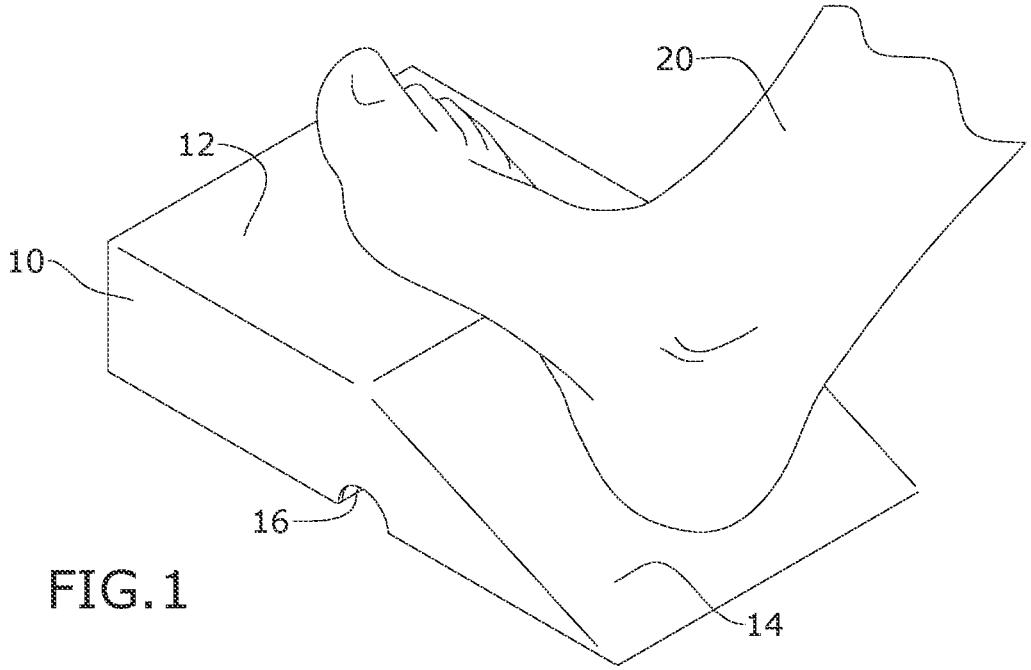
FIG. 1 is a top perspective view of an embodiment of the present invention, shown in use with a user's leg.
Figure 2:
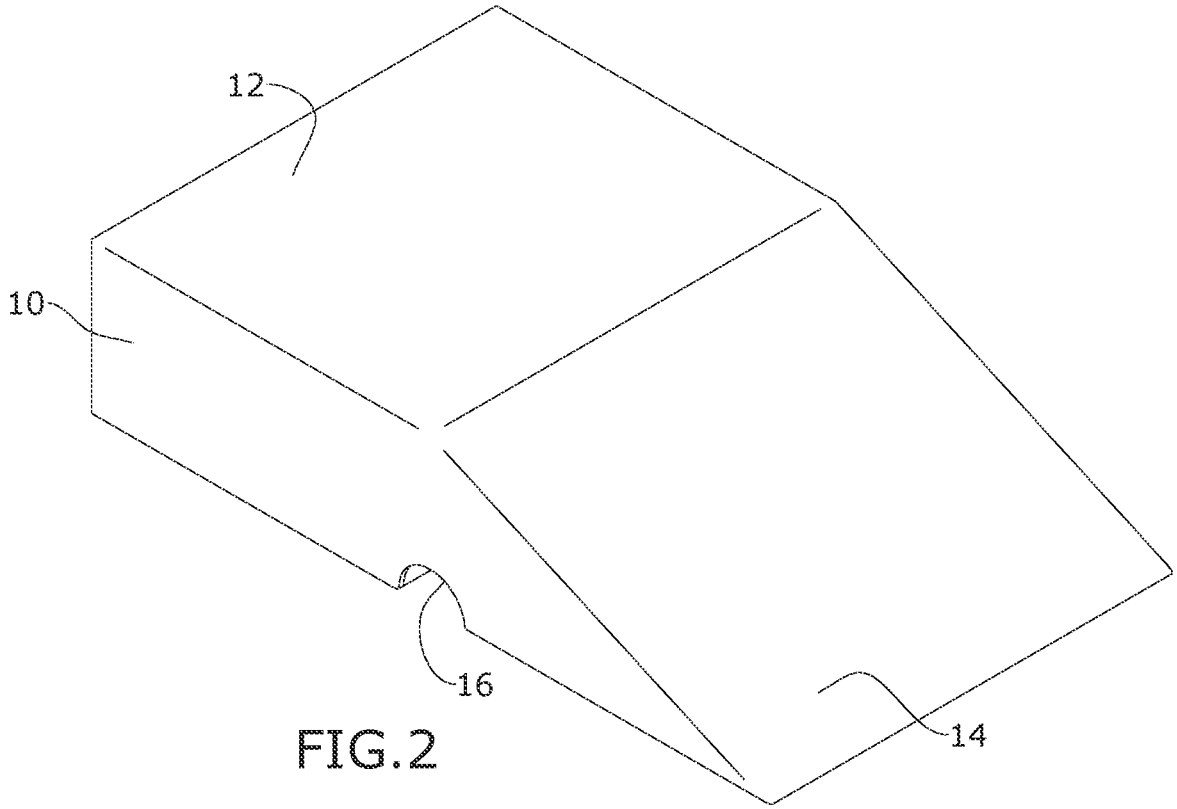
FIG. 2 is an enlarged top perspective view of the embodiment of the present invention.
Figure 3:
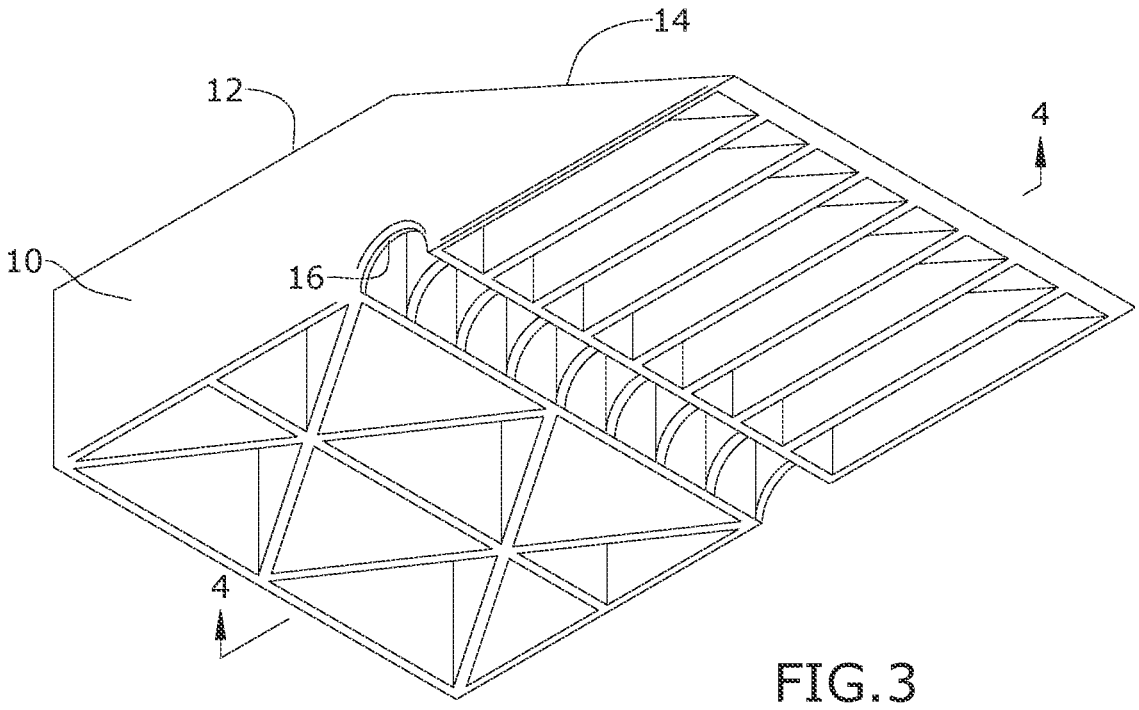
FIG. 3 is a bottom perspective view of the embodiment of the present invention, showing an exemplary ribbing configuration.
Figure 4:
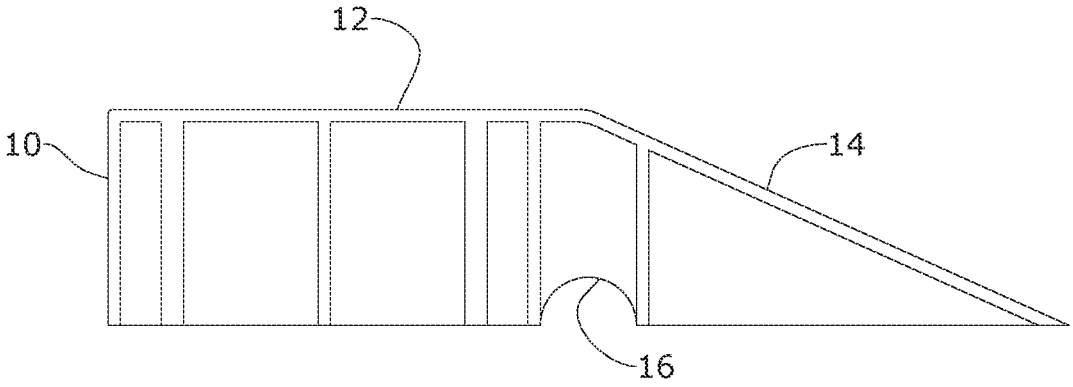
FIG. 4 is a cross-sectional view of the embodiment of the present invention, taken along line 4-4 in FIG. 3.

Making reference to FIGS. 1-4, an exercise step includes a main body 10. As shown, the main body 10 comprises a step portion 12 and a wedge portion 14 on an upper side thereof. As seen, for example, in FIG. 2, the step portion 12 is constituted by a substantially planar horizontal upper wall, and the wedge portion 14 is constituted by a sloped wall/surface extending downwardly from the step portion 12. As can be readily seen, the step portion 12 defines an uppermost surface of the exercise step and functions as a platform for a user 20 to step on during a portion of an exercise, as described in greater detail below. As shown, for example, in FIG. 4, the horizontal lengths (relative to FIG. 4) of the step portion 12 and the wedge portion 14 are approximately equal, resulting in a large foot sole landing area (the step portion 12), which will be described in greater detail with reference to FIGS. 5A-5C. As shown in FIGS. 3-4, the wedge portion 14 terminates at a bottommost surface of the main body, resulting in a smooth, continuous surface for users 20 to place the heels and middle portions of their feet in use, which will also be described in greater detail below.

As shown in FIG. 3, a band channel 16 is defined on a bottom side of the wedge 10, which allows an exercise cord 18 to pass under the main body 10 for optional use by the user 20. Further, a plurality of ribs are provided on the underside of the exercise step such that overall material may be reduced (as opposed to a solid block of material) while still providing a wedge 10 capable of withstanding large loads (e.g., various weights of users 20 as well as any additional exercise equipment, such as dumbbells, the users 20 may be holding).

Figure 5A:
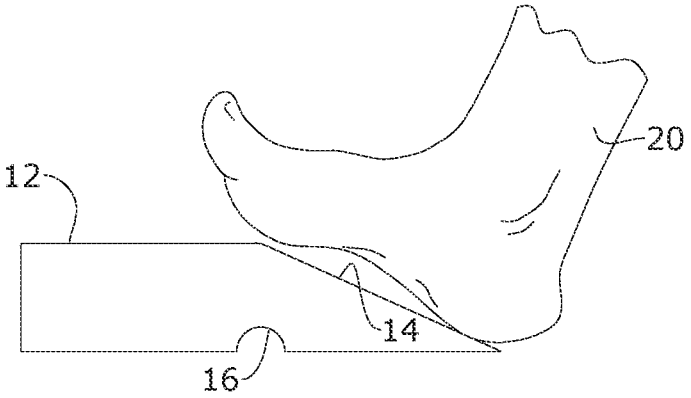
FIG. 5A is a side view of the embodiment of the present invention, shown in use with a user foot in a first, lowered position.
Figure 5B:
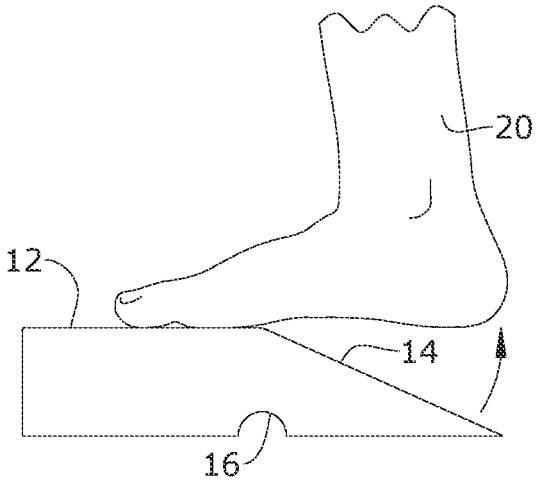
FIG. 5B is a side view of the embodiment of the present invention, shown in use with the user foot in a second, horizontal position.
Figure 5C:
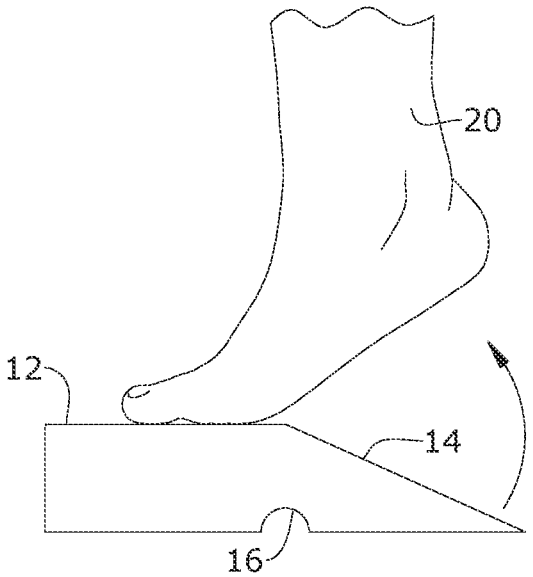
FIG. 5C is a side view of the embodiment of the present invention, shown in use with the user foot in a third, raised position.

FIGS. 5A-5C show one method of using the exercise step. First, a user 20 (by way of example, a male) places a heel on the wedge portion 14. Because the wedge portion 14 extends all the way to the ground, in use, the surface in which the user 20 places his heel is ensured to be smooth (i.e., the user 20 won't mistakenly step on any sharp edges). Gradually, the user 20 transfers his weight to the sole portion of his foot by raising his heel, as shown by the counterclockwise arrow in FIG. 5B. This movement results in the sole portion (which includes the toes) of his foot engaging the step portion 14, as shown in FIG. 5B. The step portion 14 is sized lengthwise such that any length foot can use this exercise step The user can then continue to raise his foot until he is standing on his toes, as shown in FIG. 5C. The user can then follow the reverse steps to lower his foot and may repeat in an up and down motion.

Figure 6:
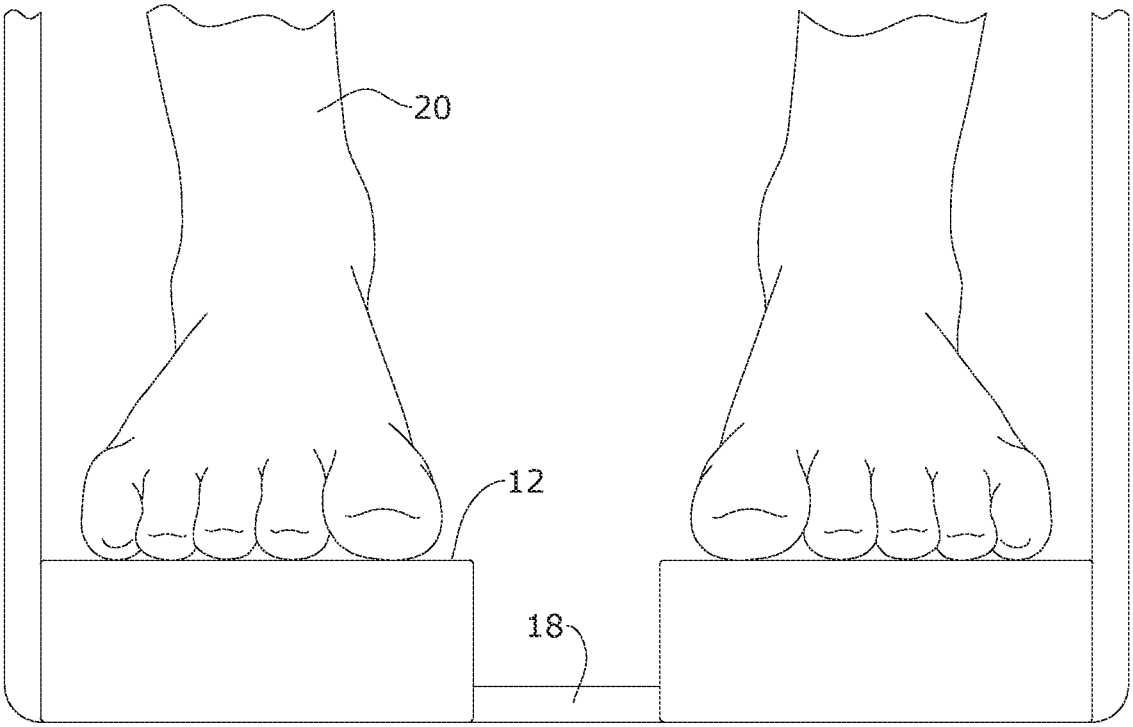
FIG. 6 is a front elevation view of two embodiments of the present invention, shown in use with an exercise cord.
Figure 7:
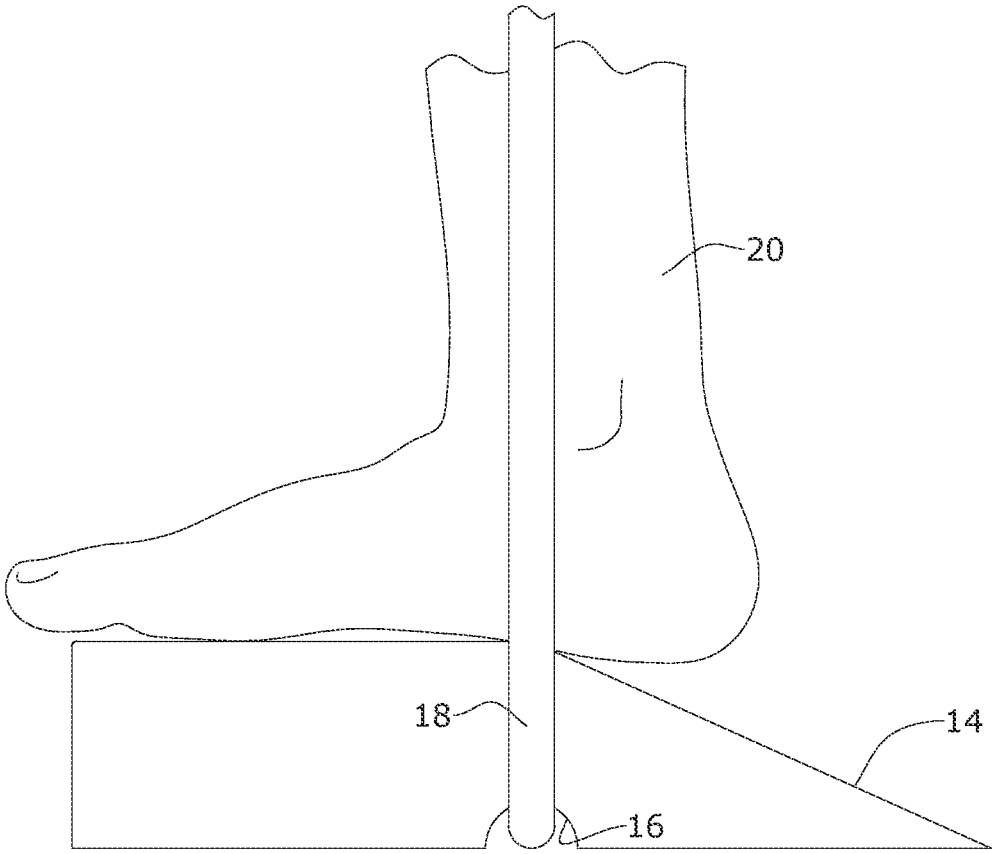
FIG. 7 is a side elevation view of the two embodiments of the present invention of FIG. 6, shown in use with the exercise cord.

Users 20 can use either a single exercise step to exercise a single leg, or two exercise steps to exercise both legs simultaneously, the method of using both simultaneously following the same procedure as described. Further, a resistance band 18 that slides in the band channel 16 at the bottom of the main body 10 may be used to further exercise the calf muscles in combination with the steps described above, as demonstrated, in part, by FIGS. 6-7. Other exercises may be performed with the exercise step described herein, such as squats, to further exercise thigh muscles, in accordance with the present invention.

A method of making the present invention may include the following. For mass production, injection molding may be used to make the mold and wedge. A mold (such as a steel injection mold) is formed with, for example, a computerized numerical control (CNC) machine. Plastic granules are heated and injected into the steel mold to form a single piece plastic wedge. While other fabrication techniques may be employed, others, such as three-dimensional printing, are unsatisfactory because wedges made by that process would not be of sufficient strength to withstand the weight of an average human body.

In certain embodiments, the exercise step may consist essentially of the structure described and shown herein. Advantageously, and as mentioned above, embodiments of the present invention are single piece exercise blocks, which simplify the manufacturing process thereof and result in lower material and production costs. Thus, an end user 20 can perform various calf and thigh exercises without the need for expensive, mechanical equipment or a trip to the gym.

In summary, an embodiment of the present invention is a light, portable piece of exercise equipment specialized to work out the calf/thigh muscles. As discussed above, prior to the present invention, there were no at-home non-mechanical exercise equipment available that concentrate on working out the calf/thigh muscles. Embodiments of the present invention are non-mechanical (so there's no need to worry about a moving part breaking), lightweight, affordable, easy to use, and users can use their own weight(s) and/or resistance bands to work out their leg muscles.

It should be understood, of course, that the foregoing relates to exemplary embodiments of the invention and that modifications may be made without departing from the spirit and scope of the invention as set forth in the following claims.

In the following claims, any labelling of elements, limitations, steps, or other parts of a claim (for example, first, second, etc., (a), (b), (c), etc., or (i), (ii), (iii), etc.) is only for purposes of clarity, and are not to be interpreted as suggesting any sort of ordering or precedence of the claim parts so labelled. If any such ordering or precedence is intended, it will be explicitly recited in the claim or, in some instances, it will be implicit or inherent based on the specific content of the claim. To further aid the USPTO and any readers of any patent issued on this application, it is additionally noted that there is no intent any of the appended claims to invoke paragraph (f) of 35 U.S.C. § 112 as it exists on the date of filing hereof unless the words "means for" or "step for" are explicitly used in the particular claim.

What is claimed is:

1. An exercise step for placing directly on a floor, the exercise step configured for use with leg exercises, the exercise step comprising:
   - a body comprising:
     - a rectangular and horizontally oriented upper wall configured to be parallel with the floor that the exercise step is placed on, wherein the upper wall is configured to support a sole portion of a user foot;
     - a sloped wall extending lengthwise from a bottommost surface directly contacting the floor of the exercise step to the upper wall, the sloped wall being configured to support a heel portion of the user foot,
     - wherein a length of the upper wall is the same as a length of the sloped wall, and wherein each said wall has a surface area that is entirely and continuously planar;
   - a plurality of ribs that support the upper wall and the sloped wall,
   - wherein the bottommost surface defines a band channel disposed between a first set of ribs of the plurality of ribs and a second set of ribs of the plurality of ribs, and wherein the band channel is disposed directly below a transition from the sloped wall to the upper wall.

2. The exercise step of claim 1, wherein the exercise step is a single-piece part.

3. The exercise step of claim 1, wherein the upper wall is an uppermost surface of the exercise step.

4. A method of exercising a user's legs, the method comprising the steps of:
   - placing two exercise steps side by side in a spaced apart arrangement;
   - each exercise step comprising:
     - rectangular and horizontally oriented upper wall configured to be parallel with the floor that the exercise step is placed on, wherein the upper wall is configured to support a sole portion of a user foot;
     - a sloped wall extending lengthwise from a bottommost surface directly contacting the floor of the exercise step to the upper wall, the sloped wall being configured to support a heel portion of the user foot,
     - wherein a length of the upper wall is the same as a length of the sloped wall, and wherein each said wall has a surface area that is entirely and continuously planar;
     - a plurality of ribs that support the upper wall and the sloped wall,
     - wherein the bottommost surface defines a band channel disposed between a first set of ribs of the plurality of ribs and a second set of ribs of the plurality of ribs, and wherein the band channel is disposed directly below a transition from the sloped wall to the upper wall;
   - engaging a band in the band channels of the two exercise steps in the spaced apart arrangement;
   - stepping on the sloped wall with the heel portion of the user foot;
   - manually pulling on the band; and
   - raising the heel portion such that the sole portion of the user foot is supported by the upper wall.

* * * * *